US005367994A

United States Patent [19]

Hinkle

[11] Patent Number: 5,367,994

[45] Date of Patent: Nov. 29, 1994

[54] METHOD OF OPERATING A DIESEL ENGINE UTILIZING A CONTINUOUSLY POWERED GLOW PLUG

[75] Inventor: Stanley J. Hinkle, West Bloomfield, Mich.

[73] Assignee: Detroit Diesel Corporation, Detroit, Mich.

[21] Appl. No.: 138,290

[22] Filed: Oct. 15, 1993

[51] Int. Cl.[5] ..... F02B 33/38

[52] U.S. Cl. ..... 123/145 A; 123/179.21

[58] Field of Search ..... 123/298, 179.6, 179.21, 123/145 A

[56] References Cited

U.S. PATENT DOCUMENTS

| | | | |
|---|---|---|---|
| 4,418,661 | 12/1983 | Esper et al. | 123/145 A |
| 4,426,568 | 1/1984 | Kato et al. | 219/270 |
| 4,475,029 | 10/1984 | Yoshida et al. | 123/145 A |
| 4,475,030 | 10/1984 | Bailey | 219/270 |
| 4,478,181 | 10/1984 | Kikuchi et al. | 123/145 A |
| 4,528,121 | 7/1985 | Matsushita et al. | 252/516 |
| 4,539,948 | 9/1985 | Toepel | 123/65 BA |
| 4,563,568 | 1/1986 | Takizawa | 219/270 |
| 4,594,975 | 6/1986 | Shigenobu | 123/145 A |
| 4,598,676 | 7/1986 | Ito et al. | 123/145 A |
| 4,633,064 | 12/1986 | Atsumi et al. | 123/145 A |
| 4,634,837 | 1/1987 | Ito et al. | 123/145 A |
| 4,635,594 | 1/1987 | Ichikawa et al. | 123/179.6 |
| 4,658,772 | 4/1987 | Auth et al. | 123/145 A |
| 4,682,008 | 7/1987 | Masaka | 219/270 |
| 4,719,331 | 1/1988 | Ito et al. | 219/270 |
| 4,742,209 | 5/1988 | Minegishi et al. | 219/270 |
| 4,806,734 | 2/1989 | Masaka et al. | 219/270 |
| 4,810,853 | 3/1989 | Maruta et al. | 123/145 A |
| 4,814,581 | 3/1989 | Nunogaki et al. | 219/270 |
| 4,816,643 | 3/1989 | Zulauf et al. | 123/145 A |
| 4,874,923 | 10/1989 | Hatanaka et al. | 123/145 A |
| 4,912,305 | 3/1990 | Tatemasu et al. | 123/145 A |
| 4,914,274 | 4/1990 | Hatanaka et al. | 123/145 A |
| 4,914,751 | 4/1990 | Masaka et al. | 123/145 A |
| 4,931,619 | 6/1990 | Ogata et al. | 123/145 A |
| 4,947,808 | 8/1990 | Kawamura | 123/179.6 |
| 4,972,811 | 11/1990 | Barsel et al. | 123/143 B |
| 5,086,210 | 2/1992 | Nunogaki et al. | 123/145 A |
| 5,189,280 | 2/1993 | Okazaki et al. | 123/145 R |
| 5,206,484 | 4/1993 | Issartel | 123/145 A |
| 5,304,778 | 4/1994 | Dasgupta et al. | 219/270 |

FOREIGN PATENT DOCUMENTS

| | | | |
|---|---|---|---|
| 2159578 | 12/1985 | United Kingdom | 123/179.6 |

*Primary Examiner*—David A. Okonsky

*Attorney, Agent, or Firm*—Brooks & Kushman

[57] ABSTRACT

A method of operating a compression ignition internal combustion engine wherein (i) the engine includes a reciprocating piston operable within a cylinder for placing a combustible fuel/air charge under compression within a combustion chamber sufficient to cause self-ignition when operating at a predetermined elevated engine temperature; and (ii) a glow plug having a heating element projecting within the combustion chamber to provide sufficient heat to the compressed fuel/air charge to ignite it when starting or operating the engine below said predetermined elevated engine temperature. The method comprises (a) providing power to said glow plug and initially establishing the temperature of the heating element at a temperature exceeding 1600° F.; (b) starting the engine; (c) concurrently continuing to operate the engine and maintaining the heating element temperature at least at 1600° F. until the engine temperature is sufficient to cause self ignition of the compressed fuel/air charge without the additional heat energy provided by the heating element; and (d) maintaining the heating element at a temperature exceeding 1600° F. throughout at least a portion of the entire remaining period of operation of the engine (and preferably between 1600°-2000° F. during the entire period of operation).

The method also includes the option of reducing the power supplied to glow plug in fixed decrements and continuing power to the glow plug at the decremented voltage level for as long as the current plug voltage is available at the decremented voltage level.

6 Claims, 3 Drawing Sheets

METHOD OF OPERATING A DIESEL ENGINE UTILIZING A CONTINUOUSLY POWERED GLOW PLUG

TECHNICAL FIELD

This invention relates to methods of operating compression ignition type internal combustion engines, notably two-cycle and four-cycle diesel engines, and in the structure of a glow plug having design features useful to the operation of the engine.

TECHNICAL BACKGROUND

Compression ignition type internal combustion engines such as the two-cycle and more recently four-cycle diesel engines are well known. U.S. Pat. No. 4,539,948, owned by the assignee of the present invention, is a typical example of a two-cycle engine, and the teachings thereof are incorporated herein by reference. Notably, the operation requires use of a glow plug positioned within the combustion chamber near the fuel injector to provide initial ignition of the compressed air/fuel mixture for whatever period of time may be required to bring the engine up to operating temperature.

A glow plug suitable for such use includes a conventional metal sheath-type glow plug capable of bringing the compressed fuel/air mixture to ignitable temperature within a relatively short period of time at ambient temperatures ranging anywhere from −25° F. and upward. Pre-glow time may be as short as 4–6 seconds at relatively high ambient temperatures extending to as much as 24–30 seconds at the lower ambient temperatures, i.e., −25° F. As an assist, it has been known to provide an air-inlet heater, particularly for high power density engines, for starting unaided at temperatures as low as −25° F. and below −25° F. with the glow plug as an additional starting device.

More recently, a great deal of commercial interest and production effort has been shown and expended in the development of ceramic/metal glow plugs and all-ceramic glow plugs. The former includes a metal heating filament, generally tungsten, molded within a ceramic heater element tip, as shown, for example, in U.S. Pat. No. 4,912,305. The latter comprises the use of electrically conductive ceramic particles molded in an all ceramic heating element such as disclosed in U.S. Pat. No. 4,528,121. The development of the ceramic glow plugs, particularly the all-ceramic glow plug, provides a glow plug capable of developing much higher tip temperatures and doing so under a much shorter pre-glow heating period of time.

SUMMARY OF THE PRESENT INVENTION

Given the high temperatures which can be developed in the all-ceramic glow plug, and considering also the ability of ceramics to maintain strength at elevated temperatures, there is created the opportunity to use a glow plug to sustain the combustion process near the end of the expansion process where combustion normally ceases because of lack of heat from the compression pressure of the cylinder. It also makes possible the continuation of the combustion process whenever these combustion pressures are inadequate to sustain combustion, thus enhancing the fuel-burning process. And further, it permits consideration of providing the means by which the point of combustion within the combustion chamber can be controlled to a precise location thereby allowing the engine designer to design the most effective combustion chamber geometry and efficient point of ignition. This improves combustion efficiency, fuel consumption, and assists in eliminating engine ignition problems. These are the objects to which the subject invention is broadly directed.

One problem associated with the higher operating temperatures and cyclical operations of the all-ceramic glow plug has been the matter of constructing an efficient and reliable connection between the lead-in power terminal and the all-ceramic heating element. Thus, it is a further object of the present invention to provide a glow plug construction which assures that a (i) mechanical connection between the terminal and ceramic heating element will be maintained under all operating conditions, even if the primary brazing bond of the terminal to the heater element should be broken, and (ii) the possibility of short circuiting the plug at the terminal-heating element connection is eliminated.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
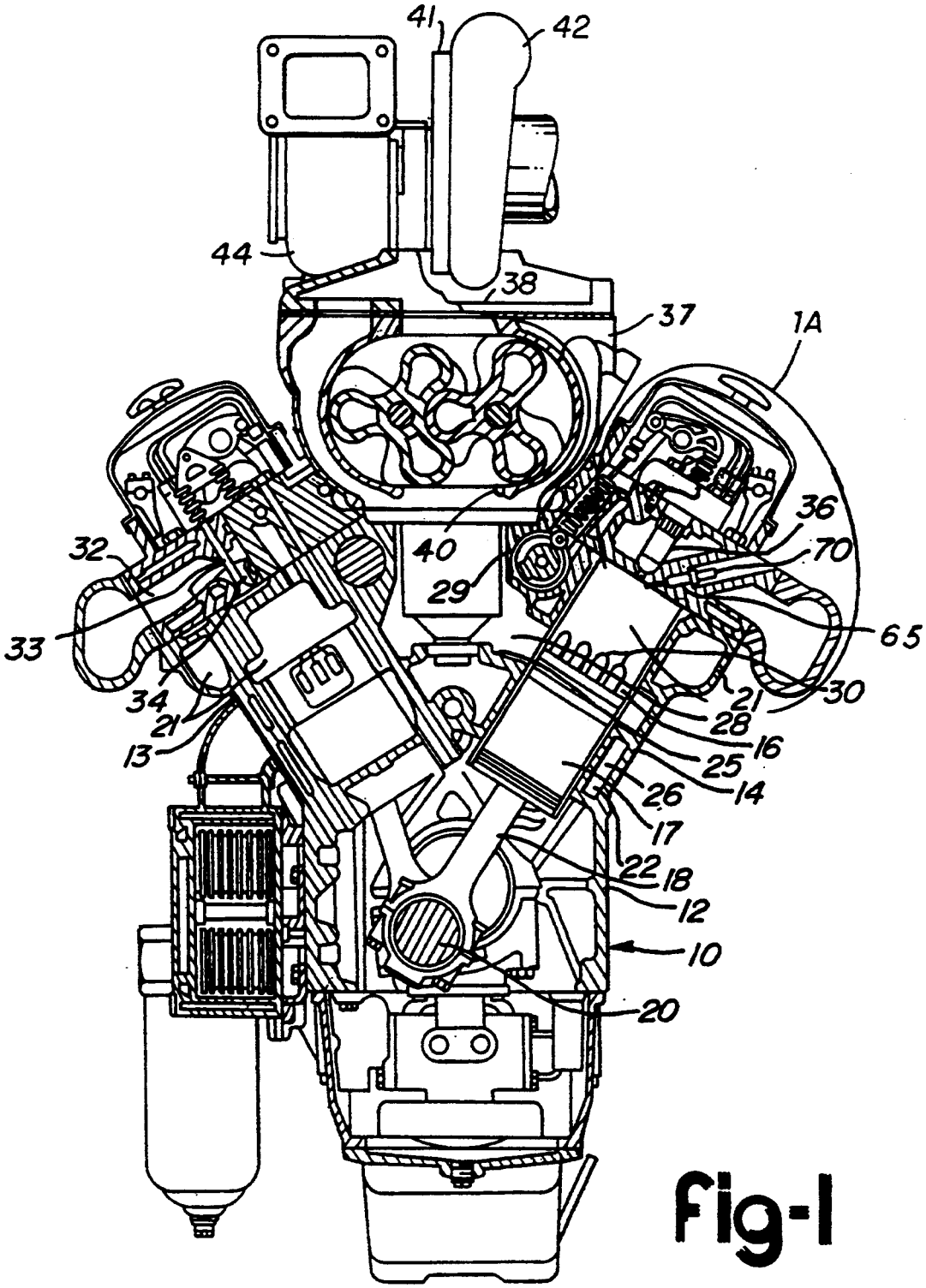
FIG. 1 is a transverse cross-sectional view of a two-cycle diesel engine in accordance with the present invention shown schematically, and including an enlarged encircled portion designated 1A showing the details of the combustion chamber, fuel injector and glow plug.
Figure 1A:
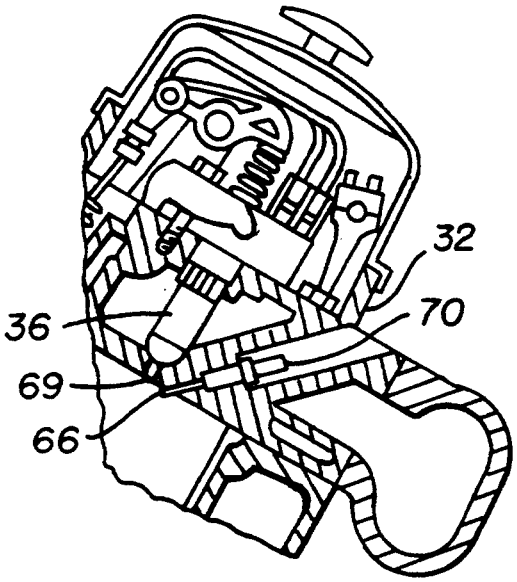
FIG. 1A is a partial cross-sectional view of enlarged and circled portion 1A of FIG. 1.

Referring to FIG. 1, including the enlarged portion designated 1A, there is represented an engine, generally indicated by the numeral 10 of the multi-cylinder two-cycle diesel type. Engine 10 includes a cast cylinder block and crankcase 12 having a pair of cylinder banks 13,14 arranged in a V, each bank being provided with a plurality of longitudinally aligned cylinders 16. A plurality of pistons 17 are reciprocally disposed, one in each cylinder, and connect through connecting rods 18 with the crankshaft 20, rotatably supported in a conventional manner in the lower crankcase portion of the block 12.

The cylinder block defines an inlet air chamber, or air box 26, outer portions of which extend around the centers of each of the cylinders between the upper and lower coolant jackets 21,22. An open central plenum 28 extends above wall 25 and connects the air box outer portions to an opening 29 in the top of the cylinder block between the two cylinder banks. Ports 30 are provided around the central portions of the cylinders to permit air to flow into the cylinders from air box 26 as controlled by the motion of the pistons 17.

Each cylinder bank is provided with a cylinder head 32 mounted to close the upper ends of the cylinders of its respective bank and containing a plurality of exhaust valves 33, exhaust passages 34 controlled by the valves, and a fuel injector 36 for each cylinder. Actuation of the valves and injectors may be conventionally controlled by the valve gear operated in timed relation with the engine crankshaft.

A Roots-type positive displacement blower 37 is centrally mounted on the cylinder block between the engine cylinder heads. The outlet opening 40 of the blower connects with the air box inlet opening 29 of the cylinder block. A turbocharger 41 is also mounted on the engine by means, not shown, and includes a dynamic compressor portion 42 and turbine portion 44. The compressor portion is connected with the inlet 38 of the Roots blower 37.

A glow plug 65 is mounted in each of the engine cylinder heads. The glow plug includes a tip portion 66 which extends into each engine cylinder 16 within the bowl portion of the associated piston 17 and near the tip 69 of the associated fuel injector 36. The glow plug 65 is connected through an electrical contact 70 with conventional means, not shown, for energizing and controlling operation of the glow plugs as required.

Remaining details of the engine and its general manner of operation may be taken from U.S. Pat. No. 4,539,948, the subject matter of which is incorporated herein.

Figure 2:
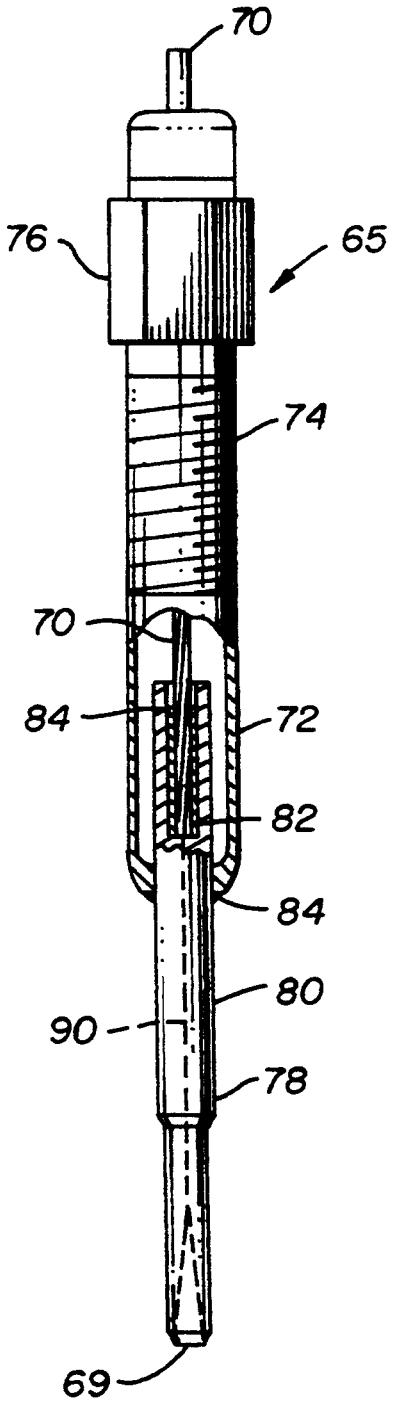
FIG. 2 is a partial cross-sectional elevation view of an all-ceramic glow plug in accordance with the present invention, which includes showing the details of the terminal-to heater-element connection.

In FIG. 2, there is shown the all ceramic tip-type glow plug preferred for use in accordance with the present invention. The glow plug, generally designated 65, includes an outer shell member 72 in the general form of a stainless steel bushing. The bushing includes an external thread portion 74 for securing the glow plug to a cylinder head 13, 14. It also includes an integral nut portion 76 of conventional octagonal configuration. Coaxially extending through the bushing from one end is a terminal 70 made of nickel wire. Coaxially extending through the other end of the bushing is the all ceramic heating element 78 having a heating tip 69 at the distal end thereof. The heating element is cylindrical with the heating tip 69 being of lesser diameter than the main body portion 80. The interior end of the heating element includes a concentric, coaxially aligned pocket 82 of limited depth. The terminal 70 is received within the pocket and is constructed so that the end of the terminal engages the bottom of the pocket, thereby establishing a mechanical interconnection between the terminal and the heating element. The pocket is partially filled to no more than about 80% of the pocket free volume with an activated braze alloy 84 to secure the terminal to the heating element. "Pocket free volume" means the volume of the pocket as remains after the terminal 70 is inserted within the pocket. The partial filling helps assure that no electrical short will occur across the terminal to the outer shell during the brazing assembly step. Likewise, the bushing is crimped or otherwise formed at its end so as to nearly engage the heating element and the bushing is secured to the heating element by the same activated braze alloy 84. The void between the heating element and the stainless steel bushing is unfilled. The terminal steel bushing and heating element are held fixed relative to one another, both rotationally and axially by means of the aforementioned brazed connections. A substantial portion of the end of the heating element, anywhere from 10 to 20% of the total length of the heating element, is received within the bushing 72.

The heating element 78 is constructed such that the electrically conductive ceramic particles are aligned in a relatively thin path extending coaxially with the heating element through body portion 80 and terminate at the heating tip 69 in substantial concentration, as shown in dotted line 90. Thus, the outer surface of the body portion acts as a heat insulator whereas the heat of the glow plug is generated exclusively at the tip 69.

The preferred ceramic for the heating element is a silicon nitride molybdenum disulfide ($SiN_4$ $MoS_2$).

Alternative electroconductive ceramic suitable for glow plug applications are as disclosed in U.S. Pat. No. 4,528,121, the teachings of which are incorporated herein.

In general, the characteristics needed for a satisfactory electroconductive ceramic include: (1) positive resistance—temperature coefficient to maintain and make possible the controlling of the current to the heating element and maintaining superficial temperature of the glow plug, i.e. controlled temperature; (2) oxidation resistance; (3) high endurance against heat shock (i.e. allowing instant re-heat to redhot condition); (4) resistivity within $10^3$ to $10^5$ Ω cm; (5) high density and (6) high mechanical strength.

The specifications for the all ceramic plug best suited for use with the present invention include:

(1) Response time for cold weather starting and for combustion assistance of alternate fuels demands a fast response time. The glow plug must reach glow temperatures within 2–5 seconds at an initial power of 150 watts.

(2) After glow time, once peak temperature is achieved, should be equal or greater than 2 minutes.

(3) Peak temperature for a 24 volt direct current (VDC) system should be equal or greater than 1000° C. Glow plug tip will be exposed to in-cylinder gas temperature up to 1850° C. and a spike voltage of 38 VDC.

(4) Corrosion characteristics for the plug and connectors must withstand exposure to salts and other cleaning agents as well as methanol and ethanol fuels.

(5) Low resistance electrical connectors must be such that engagement and disengagement shall withstand a static force of 111 Newtons (25 lbs.) applied in the direction of engagement and disengagement and a static force of 111 Newtons (25 lbs.) applied at the end of the connector perpendicular to the line of engagement and disengagement without loosening, permanently distorting the terminal, or affecting the operation of the device.

(6) Fluctural strength must be equal or greater than 80 $Kgf/mm_2$.

(7) Glow plug life—the ceramic heating element must be able to withstand engine conditions using alternate fuels such as methanol. Lifetime of the glow plug must exceed 100,000 cycles of 60 seconds on and 60 seconds off. Ceramic mechanical properties must be able to withstand high temperature engine conditions (1000° C.) and high pressures (1500 psi).

The fracture toughness of the material must be greater than 5 MPa. √m and the porosity must be minimized with no open pores. The material must have good fluctural strength at high temperatures, and should be greater than 300 MPa at 1000° C.

(8) Shock characteristics are such that the plug must withstand thermal shocks equal or greater than 1200° C. as well as mechanical shock loads of over 40 G's.

(9) Material strength must be equal or greater than 750 MPa.

(10) The plug must be insensitive to plug orientation with respect to fuel spray (erosion-free).

(11) Plugs must meet electromagnetic emission and susceptibility requirements for the control of electromagnetic interference, as disclosed in military specification EMI MIL-STD-461B.

Given a glow plug having the foregoing characteristics, and with the enhanced terminal to heating element connector system as disclosed in FIG. 2, the glow plugs may be used not only for aiding ignition of the charge during engine starting and warm-up, as well as during operating conditions where the charge temperature is unusually low, it may also be used to sustain the combustion process near the end of the expansion process where combustion normally has been suspended. Further, it may be used at part load and other operating conditions where heat controlled by-products of combustion may be high.

Figure 3:
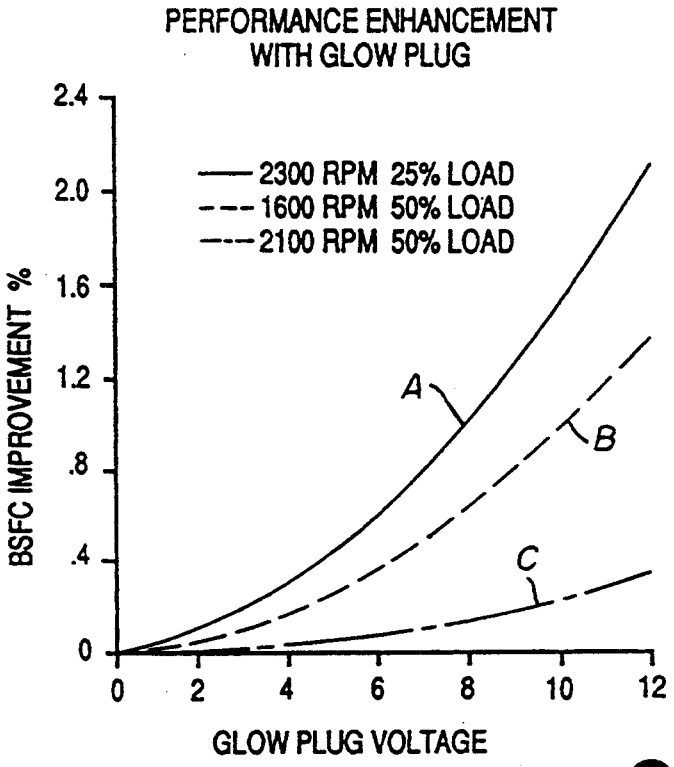
FIG. 3 is a performance chart for an all-ceramic glow plug showing the improvement in brake specific fuel consumption at different engine operating conditions and at different glow plug voltages, all in accordance with the present invention.

One example of the performance enhancement achieved by using the glow plug on a continuous or substantially continuous basis throughout operation of the engine is shown in FIG. 3. It will be noted that the improvement in brake specific fuel consumption is a function of three variables: load, speed and voltage. Management of these variables with current day electronic controls to maximize this performance over the entire engine operation range should provide the highest reliability level as well as minimum use of fuel to provide a given power. For example, the improvement in brake specific fuel consumption is most dramatic at the higher engine speeds and lower loads, as represented in curve A depicting 2300 RPM engine operation at 25% load. It is least dramatic at the higher speed or load condition as depicted in graph C representing engine operation at 2100 RPM and 50% load. Given such a variation in performance, one can provide an engine operating technique utilizing electronic controls to (i) provide continuous power to the glow plugs throughout the entire period of engine operation knowing that the major effectiveness of doing so will be limited to certain engine operating conditions or (ii) providing power to the glow plugs only when certain engine operating conditions are met and (iii) regulating these matters based on the available DC voltage at any particular time during vehicle operation.

Figure 4:
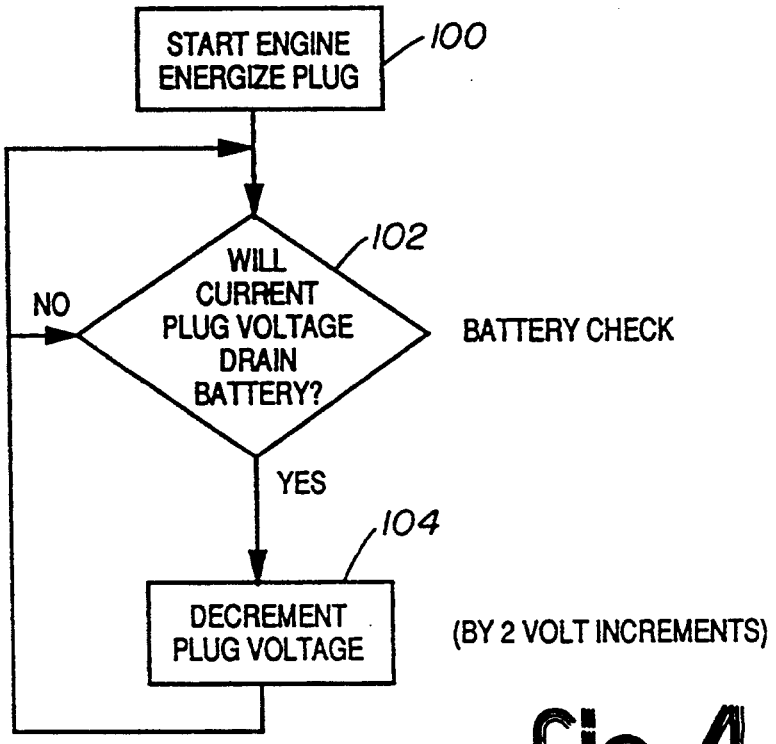
FIG. 4 is a block diagram flow chart of an engine operating program showing one possible method of operating an engine whereby the glow plug is energized and provides ignition assist during various engine operating conditions in accordance with the present invention.

In FIG. 4, there is shown an engine operating system based on the performance results shown in FIG. 3 wherein the glow plugs are energized continuously but only at a voltage which will not drain the DC voltage power supply, e.g. the 12 VDC battery. Upon initially energizing the glow plug and starting the engine 100, a constant battery check 102 is made to determine if the current plug voltage will drain the battery. If not, the glow plugs will be energized at that current voltage over all operating conditions and the benefits will be commensurate to those shown in FIG. 3. If plug voltage will drain the battery (i.e. the battery cannot be charged at a rate fast enough to preclude further discharge), the "yes" response will decrement the plug voltage 104 by a predetermined amount, e.g. 2 volts. Then the battery check is rerun and the cycle repeated. The result is that the plugs 65 will always be energized, and the level of energization will be the maximum permitted by the charging system.

Alternative methods of operation are also contemplated. For example, one could elect to forego glow plug energization at speed and load conditions shown in curve C of FIG. 3 whenever less than 12 volts is available. Thus, the charging requirements may be significantly reduced while permitting maximum voltage during conditions of speed and load yielding the greatest improvement in BSFC (e.g. curves A and B).

Other engine operating strategies are also available.

One particular advantage in maintaining power to the glow plugs throughout the entire period of engine operation is the fact that the point of combustion of the compressed air fuel charge may be closely controlled and centered about the heating tip of the glow plug, thereby providing the engine designer the opportunity to design the geometry of the combustion chamber in a manner which provides controlled combustion and the elimination of unstable combustion which may occur when the point of combustion is allowed to be influenced by other hot spots within the combustion chamber.

While the best mode for carrying out the invention has been described in detail, those familiar with the art to which this invention relates will recognize various alternative designs and embodiments for practicing the invention as defined by the following claims.

What is claimed is:

1. A method of operating a compression ignition internal combustion engine wherein said engine includes a reciprocating piston operable within a cylinder for placing a combustible fuel/air charge under compression within a combustion chamber established by said piston and cylinder in conjunction with a cylinder head member sufficient to cause self-ignition when operating at a predetermined elevated engine temperature;

said engine further including a glow plug secured to said cylinder head and having a heating element projecting within said combustion chamber to provide sufficient heat to the compressed fuel/air charge to ignite it when starting or operating said engine below said predetermined elevated-engine temperature; said method comprising:

(a) providing power to said glow plug and initially establishing the temperature of said heating element at a temperature exceeding 1600° F.;

(b) starting the engine;

(c) concurrently continuing to operate the engine and maintaining said heating element temperature at least at 1600° F. until said engine temperature is sufficient to cause self ignition of the compressed fuel/air charge without the additional heat energy provided by said heating element; and (d) maintaining said heating element at a temperature exceeding 1600° F. throughout at least a portion of the entire remaining period of operation of said engine.

2. A method as in claim 1 wherein said heating element is maintained at a temperature exceeding 1600° F. throughout the entire remaining period of operation of said engine.

3. A method as in claim 1 including the further step of reducing the power supplied to glow plug in fixed decrements and continuing power to the glow plug at the decremented voltage level for as long as the current plug voltage is available at the decremented voltage level.

4. A method as in claim 3 including the further step of discontinuing power to said heating element during those periods said engine is operating at a speed and load below a respective predetermined value.

5. A method as in claim 4 including the further step of discontinuing power to said heating element during those periods said engine is operating at a speed and load below 2100 rpm and 50%, respectively.

6. A method as in claim 1 wherein said heating element is maintained at temperatures between 1600° F. and 2000° F. throughout the entire remaining period of operation of said engine.

* * * * *